US005354606A

United States Patent [19]

Kjelby et al.

[11] Patent Number: 5,354,606

[45] Date of Patent: Oct. 11, 1994

[54] PLATE OF FLAX FIBER FELT

[75] Inventors: Benny Kjelby; Erik Jepsen, both of Klarup; Kai Bastiansen, Copenhagen, all of Denmark

[73] Assignee: Dansk Horindustri A/S, Klarup, Denmark

[21] Appl. No.: 182,678

[22] PCT Filed: Nov. 29, 1990

[86] PCT No.: PCT/DK90/00310

§ 371 Date: May 22, 1992

§ 102(e) Date: May 22, 1992

[87] PCT Pub. No.: WO91/08332

PCT Pub. Date: Jun. 13, 1991

Related U.S. Application Data

[63] Continuation of Ser. No. 859,360, May 22, 1992, abandoned.

[30] Foreign Application Priority Data

Nov. 30, 1989 [DK] Denmark ..... 6060/89

[51] Int. Cl.[5] ..... D04H 1/08; B32B 5/22

[52] U.S. Cl. ..... 428/280; 428/300; 428/296

[58] Field of Search ..... 428/280, 300

[56] References Cited

U.S. PATENT DOCUMENTS 4,908,176 3/1990 Kato ..... 264/122

FOREIGN PATENT DOCUMENTS

2510911A1 10/1975 Fed. Rep. of Germany .

1363653 8/1974 United Kingdom .

*Primary Examiner*—George F. Lesmes

*Assistant Examiner*—Kathryne E. Shelborne

*Attorney, Agent, or Firm*—Fitch, Even, Tabin & Flannery

[57] ABSTRACT

A plate of felt is manufactured by needle bonding a carded mat (1) of preferably 5 to 15 cm long fibres (2). The fibres (2) are made completely or substantially of flax fibres (2) having torn, defibrated and frayed ends as a result of tearing by an overstretching process.

9 Claims, 1 Drawing Sheet

PLATE OF FLAX FIBER FELT

This application is a continuation of application Ser. No. 07/859,360 filed May 22, 1992, now abandoned.

TECHNICAL FIELD

The invention relates to a plate of felt manufactured by needle bonding a carded mat of substantialy 5 to 15 cm long fibres.

BACKGROUND ART

The flax plant Linum usitatissimum comprises a stem of 60 to 80 cm according to strain and growth. The stem is reinforced by strong fibre bundles for providing a sufficient rigidity, said fibre bundles extending from the root to the top of the plant. The fibre bundles are arranged outermost in the reed of the stem, and the spaces between the fibre bundles have been filled with ligneous cellulosis, which provides the so-called shives after the flax stem has been processed to separate the fibres.

In order to separate the long flax fibres from the xylem of the stem, the flax must be subjected to a so-called retting after the harvesting, said retting being a microbiological process. Today it is, however, possible to replace the conventional and rather uncertain retting process with a retting in water admixed enzymes. The water retting causes a decomposition of the hemicellulosis and pectine binding the fibres together as well as binding the fibres to the xylem like an adhesive.

By the conventional retting, the microorganisms supply the enzymes, said retting usually taking place in two different ways: Water retting and dew retting. The dew retting is the most interesting process in the present connection, and it takes place when the cut stems are lying in the fields after the harvesting. The water retting takes place in lakes or streams where the sheaves of flax have been placed, but due to the pollution of the streams the water retting has been forbidden in many places.

In principle, all the above three retting processes can be used in connection with production of fibres provided they take place in a suitable manner. The resulting fibres can by way of a further processing be used for the manufacture of plates of flax fibres according to the invention. The water retting can take place in closed reservoirs optionally containing enzymes as described in Danish Patent Application No. 4757/86.

By the conventional production of flax, the stems are subjected to a retting and drying followed by a number of mechanical processings with the result that the flax fibre bundles are separated from the shives. The flax fibres are very strong, and their length is substantially the same after the separation from the shives as in the stems. A small amount of the fibres is destroyed during the processing partly due to an overretting and partly due to the mechanical processing, and these fibres are separated and sold as flax tow. Unlike the first-rate fibres which are processed while arranged in parallel in bundles, the flax tow fibres are randomly arranged relative to one another. However, the flax tow still comprises fibres of a considerable length and cannot therefore be processed by means of conventional textile machines, such as machines for the processing of cotton and wool.

It is not possible to manufacture a plate of flax fibres directly from flax fibres by the conventional processing in needling machines because such flax fibres are too long and too smooth. Attempts have been made at manufacturing a plate of flax fibres by needling (as described in Example 1) such fibres shortened by way of cutting, but without success.

A complete wetting followed by a chemical treatment allows the flax fibres to be separated into so-called single fibres, i.e. singlecelled fibres resembling cotton. The process is called a cottonizing, but the resulting smooth short fibres are not suited for the manufacture of plates of flax fibres by way of needling.

DISCLOSURE OF INVENTION

The plate of flax described in the introduction is according to the invention characterised in that the fibre mat is made exclusively or with an essential part of flax fibres having torn, defibrated and frayed ends.

As a result, the use of fibres having torn, defibrated and frayed ends obtained as a result of tearing by an overstretching process renders it possible to manufacture a suitable plate of flax fibres by a needling process. The result is probably achieved because the particular structure of the flax fibres in combination with residues of pectin and hemicellulose implies that the fibres can retain one another so as co allow the needle bonding.

The properties of the flax fibres provide the plate of flax fibres with some physical and physical/chemical properties making the plate suited, yes even more suited for some purposes than other plates of textile felt.

The most important characteristics are:

1: Compressibility even at high loads, i.e. in other words that the plate of felt possesses an "additional compressibility" after the visible compression.

2: Fast absorption and release of water vapour to the surroundings.

3: Capability of absorbing up to 18% of water without being wet to the touch.

4: Better diversion of static electricity than wool at the same relative moisture in the atmosphere.

The mechanical strength of a flax fibre felt manufactured by needling depends not only on the character of the fibre, cf. above, but also on the number of needle sticks per $cm^2$. The latter applies both to the tensile strength of the felt and to the force necessary for extracting the fibres from the felt.

A good resistance to fibre extraction requires many needle sticks per $cm^2$ which results in a relatively solid plate of a high specific weight. As mentioned above, such a plate of flax fibres possesses a good tensile strength and in addition a good carrying capacity, as well as a surprisingly good residual elasticity, i.e. recovery at relatively high loads.

A comparatively softer, i.e. more voluminous plate of fibres may according to the invention be achieved by allowing some of the fibres to be crimped thermoplastic fibres of the type usually used for the manufacture of needle felt. Beyond ensuring a comparatively high compressibility and low specific weight of the plate of felt, the thermoplastic fibres assist in the bonding of the fibres when the plate of the blended fibres are subjected to a short heating after the needle bonding. The heating is followed by a cooling in such a manner that the thermoplastic fibres are relaxed and set in the form and position between the flax fibres resulting from the needling process.

In addition to the good properties of a plate of flax fibre felt, a plate comprising the above suitable thermoplastic plastic fibres possesses, as mentioned, an improved immediate softness and elasticity as well as a substantially improved volume stability, i.e. recovery capacity, when it is subjected to loads in the wet state.

A flax fibre felt of blended fibres can be manufactured according to the three different principles stated below:

1. Needle bonding a mat of fibres in the desired blending proportion, said fibre blending being carried out before and in connection with the carding process.
2. Needle bonding a mat of flax fibres to a mat of for instance thermoplastic plastic fibres.
3. Needle bonding a preneedled flax felt to a preneedled felt of thermoplastic fibres or other fibres.

The entire manufacturing process includes the steps of blending, carding, laying out the mat, needling and winding up and is described in connection with Example 1.

The flax fibres and for instance polypropylene fibres are blended so as to achieve the properties described for a plate of flax fibre felt blended with thermoplastic plastic fibres, and the success of the above blending is probably ensured because a complete heat-resistant framework of flax fibres is formed. The framework of flax fibres carries the thermoplastic fibres during the relaxing and the succeeding setting thereof. Furthermore, it turned out to present a great advantage that the needle bonding of the flax fibres is carried out with thermoplastic plastic fibres blended therein because such a procedure results in a reduced development of dust, i.e. a reduced loss of fibres during said needling process.

The above reinforcing effect of the flax fibres in a plate of felt of both flax fibres and thermoplastic fibres is particularly good when a plate of felt containing a relatively high amount of thermoplastic fibres is subjected to deforming forces at temperatures allowing a thermosetting of the plastic fibres. The processing is carried out at temperatures near the melting point of the fibres, and the amount of flax fibres allows the plate to maintain its felt structure and furthermore said plate to be pulled through the processing machine without causing significant changes in the length and width of the plate.

When the flax fibres are carded and needle bonded separately, it is necessary to adjust the relative humidity of the flax in such a manner that it becomes resilient, but not so soft that the needling process cannot be carried out. In this state, the needling process cannot avoid destroying some of the flax fibres which results in development of dust and short fibres. The resistance to fibre extraction from the felt of the short fibres is very poor. The adding of polypropylene fibres renders it possible to process flax fibres containing a relatively lower or higher amount of water because the changed structure and friction of the mat of blended fibres results in a significantly improved needling process involving a substantially lower amount of developed dust and destroyed fibres.

Some of the fibres may according to the invention be wool fibres with the result that a corresponding improvement of the needling process is achieved. The improvement is particularly obvious when lanolin-containing raw wool is used.

BRIEF DESCRIPTION OF DRAWING

The invention is described in greater detail below with reference to the accompanying drawing, in which.

BEST MODE FOR CARRYING OUT THE INVENTION

Figure 1:
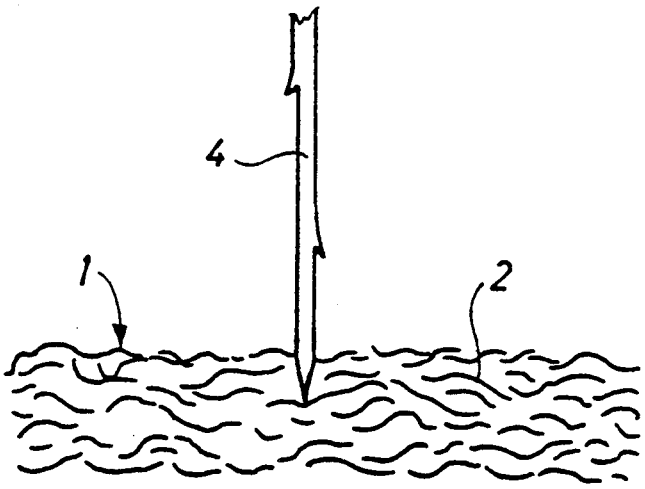
FIG. 1 is a diagrammatic side view of a portion of a mat of flax fibres ready for being processed by needling, FIG. 2 corresponds to FIG. 1, but after needling by a single needle.
Figure 4:
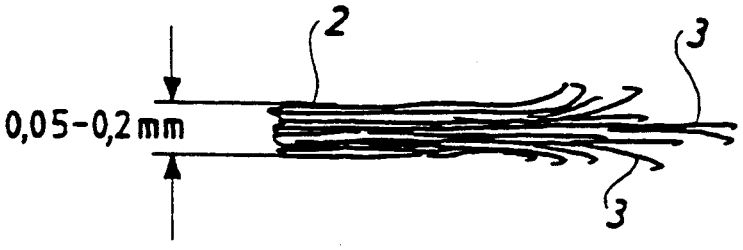
FIG. 4 is a diagrammatic side view of the end of a flax fibre which has been torn by an overstretching process.

The fibre mat 1 of FIG. 1 comprises 5 to 15 cm long flax fibres 2 and optionally other fibres, such as thermoplastic plastic fibres and wool fibres. The flax fibres 2 have been subjected to an overstretching process until tearing as described in greater detail below, whereby the ends of the fibres are shaped as indicated in FIG. 4. The relatively coarse flax fibre bundles 2 are composed of so-called single fibres and present a frayed appearance due to the tearing of the single fibres.

Figure 2:
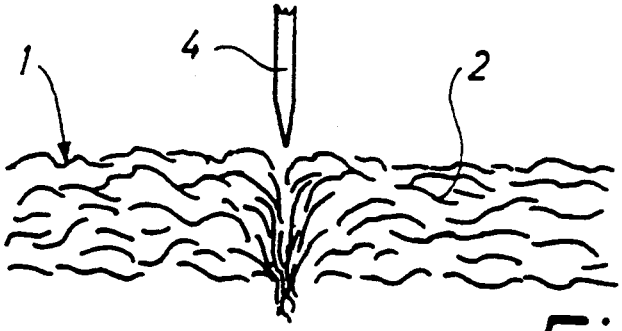

The above mat 1 of fibres is subjected to a needling process in a conventionally known manner, cf. FIGS. 1 and 2, where only a single needle 4 of a needling machine is shown.

Figure 3:
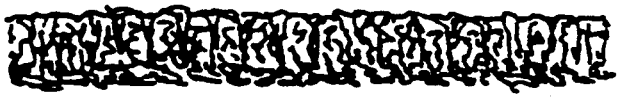
FIG. 3 is a diagrammatic side view of a portion of a felt plate according to the invention.

After the needling process the mat of fibres presents the form of FIG. 3 corresponding to the form of a conventional plate of felt apart from the fibre materials being present.

The plate of felt according to the invention and the manufacture thereof are described in greater detail below by means of the accompanying Examples.

EXAMPLE 1

The starting material for the manufacture of a plate of flax fibre felt according to the invention is flax straw. Straws of fibre-flax as well as straws of oil-flax can be used, but the best fibres originate from fibre-flax.

When the flax straw is ripe and has been harvested, it is placed in swaths in the fields so as to be subjected to the so-called dew retting. The cut flax is turned at regular intervals in the fields in such a manner that a uniform retting is achieved. The retting is closely observed, and when a suitable retting is completed and-the straw is sufficiently dry, the flax is baled and transported to the factory for scutching etc. The scutching is carried out in a scutching mill where the flax straws are crushed between rollers simultaneously advancing the straws and fibres to several succeeding pairs of rollers. The xylem, i.e. the shives, crushed and released from the fibres is separated from the fibres in a conventional manner in a shaker.

During the advancing in the machine, the fibres are stretched so much that the resulting tension exceeds the tearing strength of the fibres. The stretching is carried out by allowing the rollers to pull the fibres forwards at an increasing speed, or in other words a pair of rollers in front rotate at a higher speed than the pair of rollers therebehind. As a result, the fibres are broken into smaller lengths, and by a suitable adjustment of the machine it is possible to ensure an average length of 100 mm. In addition it is ensured that the fibres are suited for the manufacture of the plate of flax fibres according to the invention.

The dividing of the fibres can also be carried out after the scutching by allowing the raw flax fibres to pass an opener, i.e. a so-called Wolfe, comprising a front pair of feeding rollers where the speed of said rollers has been adjusted so as to be suitably slow relative to the drawing of the Wolfe.

Subsequently, the flax fibres are carried to a carding machine where they are dosed and advanced to the cards by means of suitable feeding boxes. A carded web of a weight of approximately 100 g/m$^2$ is manufactured at the cards. The carded web is by means of a crosslaying device placed on conveyors to form a mat comprising 1000 g of fibres per m$^2$. The mat is carried through compressing bands into the needling machine where it is processed by a large number of needles moving up- and downwards through the mat. By the downward movement of the needles, the fibres are extracted from the top side of the mat through said mat by means of the downward barbs placed on the sides of the needle shaft of the needles. Each time the needles have been retracted from the formed layer of felt, said layer of felt is moved a short distance forwards. The completed felt is clean-cut in the edges and wound up in rolls for sale. The felt is suited for padding plates in connection with manufacture of furniture. It can be cut, i.e. factory-tailored, in such a manner that a series production of furniture is highly facilitated compared to the previously used manual placing of flax fibres in connection with a padding procedure.

EXAMPLE 2

A padding plate is manufactured which comprises 85% of flax fibres of an average length of 65 mm formed by tearing off cleaned raw flax fibres and 15% by weight of new crimped polypropylene fibres of a melting point of 160° C. and cut in lengths of between 100 to 150 mm. The article is manufactured such that a mat of 400 g of flax fibres per m$^2$ is placed on a conveyor by means of a carding machine. Subsequently, a second mat also of 400 g/m$^2$ is placed atop the flax fibre mat on the same conveyor, said second mat being produced by a second carding machine and comprising 60 to 70% of flax fibres and 30 to 40% of polypropylene fibres. The double mat passes the needling machine and is needle bonded by 10 sticks per cm$^2$ to form a laminated padding plate. The plate comprises a rather solid bottom side and a top side which compared to the bottom side is substantially softer, i.e. more voluminous. The plate is suited as padding material in connection with series production of sitting furniture, mattresses for beds and the like.

In order to avoid a too high development of dust during the production, it was in Example 1 necessary to use flax fibres containing 12% of water. Now it turned out to be possible to use flax fibres containing 8 to 12% of water by simultaneously using the polypropylene fibres and while maintaining a low development of dust and a low loss of crimped fibres in the needling machine.

EXAMPLE 3

A mat of 400 g/m$^2$ of flax fibres is initially placed on a conveyor, as described in Example 2. Subsequently, a mat is placed thereon, said mat containing a blending of corresponding flax fibres and crimped polypropylene fibres of an average length of 65 mm and a melting point of 160° C. The second mat contains 40% of polypropylene. The entire layer of fibres is carried through the compressing section to the needling machine subjecting the layer to a needling with 15 sticks per cm$^2$. By such a needling process, a rather large portion of the polypropylene fibres are pulled through the bottom layer of flax fibres with the result that this layer also comprises a certain amount of polypropylene. The needled article is subsequently carried through an oven subjecting said article to a thermosetting where both surfaces are heated either simultaneously or one by one in such a manner that the polypropylene fibres are relaxed. After having passed the oven, the article is cooled by means of air blown thereon, clean-cut and wound up in rolls for sale or cut in sheets.

The article can be heat-treated either on one side or on both sides. The heat-treatment can be either radiation or blowing of hot air. A combination of the two methods is particularly favourable, and it is carried out by the surface being subjected to radiant heat simultaneously with the bottom side of said article sliding across a grating, below which a suitable slight low pressure is established. In this manner, the hot air from the top side of the article can be suitably directed into the material in such a manner that the fibre relaxation also occurs therein. The succeeding cooling can also be such that a pressure-gradient is established which forces the air through the article.

A plate of flax fibre of the above composition and manufactured according to Example 3 is suited as floor covering.

The use of thermoplastic bicomponent fibres renders it possible to achieve a very reliable surface standing up to much wearing because the fibres stick to one another in the points of contact during the heat processing. The bicomponent fibres usually comprise a core of thermoplastics of a relatively high melting point surrounded by a cover of the same polymer, but of a substantially lower melting point.

When the conventional polypropylene fibres mentioned in Example 3 are used, a heating of one or both sides of the length of felt by means of for instance radiating members results in formation of a coherent surface structure of thermoplastics with flax fibres embedded therein, said heating being carried out to such a high temperature that the plastic fibres may be welded together. The coherent surface structure results from pressing the length of felt between a cooled steel roller and a counterpressure roller also being cooled and furthermore being provided with a rubber coating.

Such a plate of felt coated with plastics is permeable to water vapour and diverts possible statical electricity.

EXAMPLE 4

A plate comprising a combination of flax felt and wool felt is manufactured in the following manner:

A mat of flax fibre is placed from a card line on a conveyor. The mat is of a weight of approximately 400 g/m$^2$. The flax fibres are made of cleaned raw fibres as described previously, said fibres being mechanically divided by an overstretching process in such a manner that flax fibres of a varying length are formed, where the length is in an average range of between 50 and 70 mm. The mac of flax fibres is conveyed through a compressing band to a needling machine. The needling machine subjects the mat to-a relatively random needling, i.e. a so-called preneedling by 5 sticks per cm$^2$. A mat of approximately 300 g/m$^2$ of raw wool is placed from a second card line atop the above web of flax fibres. The combined mat of flax felt and raw wool is conveyed on the conveyor through a compressing band to a needling machine, where the two layers of fibres are laminated. The lamination or the needling is performed with approximately 5 sticks per cm$^2$ penetrating to such a degree that the wool fibres clearly penetrate the layer of flax fibres.

Such a combined padding plate of flax fibres and wool fibres is extremely suited for padding of both sitting furniture and mattresses.

Very coarse and very inexpensive raw wool can be used for the above article, said wool per se being unsuited for the manufacture of padding materials. However, in combination with flax as stated in this Example, such wool renders it possible to manufacture laminates of a strength sufficent for the purpose by adjusting the needling intensity in the felt of flax fibres arranged below the layer of wool. In other words, a 100% natural product is obtained which presents a good elasticity and almost the same capacity of absorbing and releasing water vapour as pure wool.

In addition to the above additional and more or less expectable properties, the present invention provides a surprising improvement of the needling process per se because the wool fibres facilitate the needling process to a higher degree than the polypropylene fibres at the same time as said process involves development of less dust.

We claim:

1. A plate of felt comprising:

a carded mat having flax fibres of substantially 5 to 15 cm long;

torn and frayed ends on the fibres caused by overstretched and breaking of the fibres to produce the torn and frayed ends;

the flax fibres being raw fibres that are partially retted; and needle fibres extracted from the top side of the mat and extended through the mat to needle bond the fibres into the plate of felt.

2. A plate of felt as defined in claim 1, wherein the carded mat further contains crimped thermoplastic fibres.

3. A plate of felt as defined in claim 2, wherein stresses in the thermoplastic fibres caused by the needle bonding are reduced by heating the plate of felt.

4. A plate of felt as defined in claim 2, wherein the thermoplastic fibres have a core material surrounded by a thermoplastic cover material which has a lower melting point than the core material.

5. A plate of felt as defined in claim 1, wherein the carded mat further contains wool fibres.

6. A plate of felt as defined in claim 5, wherein the wool fibres are lanolin-containing raw wool fibres.

7. A plate of felt as defined in claim 5, wherein the flax fibres and the wool fibres are contained in separate plates which are combined by needle bonding to form the plate of felt.

8. A plate of felt as defined in claim 2, wherein the thermoplastic fibres of one or both surfaces of the plate of felt are melted or compressed so as to render the surfaces coherent and smooth.

9. A plate of felt in accordance with claim 1 in which the partially retted fibres have residues of pectine and hemicellulosis.

* * * * *

UNITED STATES PATENT AND TRADEMARK OFFICE

CERTIFICATE OF CORRECTION

PATENT NO. : 5,354,606

DATED : October 11, 1994

INVENTOR(S) : Kjelby, et al.

It is certified that error appears in the above-indentified patent and that said Letters Patent is hereby corrected as shown below:

Column 7, lines 29-30, change "overstretched" to --overstretching--.

Signed and Sealed this

Eighteenth Day of April, 1995

Bruce Lehman

*Attest:*

BRUCE LEHMAN

*Commissioner of Patents and Trademarks*

*Attesting Officer*